US006840132B2

(12) United States Patent
Gohrbandt et al.

(10) Patent No.: US 6,840,132 B2
(45) Date of Patent: Jan. 11, 2005

(54) ADJUSTABLE PEDAL UNIT

(75) Inventors: Uwe Gohrbandt, Haan (DE); Ulrich Dipl.-Ing Kizak, Niederwinkling (DE); Heinz-Walter Heinemann, Wuppertal (DE); Jürgen Weyreuther, Hengersberg (DE)

(73) Assignee: Edscha AG, Remscheid (DE)

( * ) Notice: Subject to any disclaimer, the term of this patent is extended or adjusted under 35 U.S.C. 154(b) by 60 days.

(21) Appl. No.: 10/239,909

(22) PCT Filed: Apr. 5, 2001

(86) PCT No.: PCT/DE01/01365

§ 371 (c)(1),
(2), (4) Date: Sep. 26, 2002

(87) PCT Pub. No.: WO01/77772

PCT Pub. Date: Oct. 18, 2001

(65) Prior Publication Data

US 2003/0047022 A1 Mar. 13, 2003

(51) Int. Cl.[7] ..... G05G 1/14
(52) U.S. Cl. ..... 74/512
(58) Field of Search ..... 74/512, 513, 560

(56) References Cited

U.S. PATENT DOCUMENTS 3,151,499 A 10/1964 Roe ..... 74/560
5,884,532 A * 3/1999 Rixon et al. ..... 74/512
6,019,015 A * 2/2000 Elton ..... 74/513
6,212,970 B1 * 4/2001 Bortolon ..... 74/512

FOREIGN PATENT DOCUMENTS

| | | |
|---|---|---|
| EP | 0936527 | 8/1999 |
| JP | 07191773 | 7/1995 |
| JP | 08042612 | 2/1996 |

* cited by examiner

*Primary Examiner*—Thomas R. Hannon
*Assistant Examiner*—Vicky A. Johnson
(74) *Attorney, Agent, or Firm*—Davidson, Davidson & Kappel, LLC

(57) ABSTRACT

A pedal unit including a four-bar parallelogram is made up of an upper retainer piece, a lower retainer bracket, with footplate attached and two roughly parallel arms, which are each rotatably mounted at one end on the upper retainer piece and at the other end on the lower retainer bracket. The pedal unit may rotate about a main bearing. An adjuster device for the adjustment of the footplate, predominantly in the X-direction, is provided. The upper retainer piece and a sliding block are mounted on a guide pinion in a displaceable and adjustable manner. A rod bearing is arranged on the guide pinion, whereas the main bearing is arranged on the sliding block and a main bearing tie and a rod bearing tie are provided, one end of each being rotatably connected to a solid bearing block and the other free end rotatably mounted in the main bearing or the rod bearing. A longitudinally adjustable strut is mounted between the arms with both ends rotatably connected to the above arms.

12 Claims, 10 Drawing Sheets

ADJUSTABLE PEDAL UNIT

BACKGROUND OF THE INVENTION

The invention relates to a pedal mechanism having a four-bar parallelogram formed from an upper holding part, a lower holding link with a footplate attached thereto, and two roughly parallel legs.

In order for it to be possible to adapt the operation of pedals, for example in a motor vehicle, to the different size of drivers and thus to the different position of the optimum force introduction point for the driver, a pedal mechanism must be adjustable in the direction of travel (X) and/or in height (Z). Adaptation of the pedals to different proportions and sitting habits of the drivers can thus also be carried out.

Solutions known in the prior art for adjustable pedal mechanisms make possible adjustment of the pedal virtually steplessly along a defined, usually curved path.

The pedal mechanism described in the introduction is known from JP 71 91 773. This mechanism has the disadvantage, however, that the adjustment in the X direction takes place on a circular path which is formed by the radius of the distance from the force introduction point to the main bearing, and that, moreover, the main bearing is fixed in its position by arrangement on a support which is stationary in relation to the body. Adjustment is effected by virtue of the spindle driven by the actuating motor 66 attached to the web pressing on the extended end of the lever, as a result of which the four-bar linkage rotates counterclockwise about the pivot bearing. This leads to the pushrod bearing likewise being pivoted, clockwise, about the pivot bearing. The main bearing is fixed, as the bearing shaft is articulated on the stationary bearing block. A further disadvantage can be seen in the fact that there is no non-positive connection between the threaded rod and the lever end. In this connection, moreover, only an adjustment essentially in the X direction is brought about, so that the points for the pressure point C which can be set by the adjustment lie along a pivoting movement carried out about the main bearing with the radius L2a. The requirement of the automotive industry that the angular position of the pushrod may change by only a very narrowly dimensioned angular range on adjustment cannot be met by this arrangement.

From EP 0 936 527 A2, an adjustable pedal arrangement for motor cars is known, with an auxiliary lever which is mounted pivotably on a front shaft and is moved by a pedal lever which is mounted pivotably on a rear shaft arranged behind and below the front shaft. The auxiliary lever and the pedal lever are connected by an adjustable rod which is arranged essentially parallel to the plane in which the front shaft and the rear shaft lie. The auxiliary lever and the pedal lever form, with the adjustable rod, a parallelogram, that side of which formed by the rod is length-adjustable in order for it to be possible to modify the initial angular position of the footplate which is attached at the lower end of the pedal lever. Connected to the auxiliary lever is an operating rod for a brake or a clutch, which is moved by the forward movement of the footplate. In this way, the auxiliary lever, which moves the operating rod (pushrod), is moved by means of the pedal lever and the adjustable rod. Modification of the setting angle of the footplate makes possible greater variation of the footplate position without having to raise the arrangement in height of the footplate excessively, as the parallelogram arrangement keeps the pedal travel essentially unchanged.

A pedal mechanism described in the introduction is known from U.S. Pat. No. 3,151,499. In this pedal mechanism, the upper holding part, with an integrated pushrod bearing, is pivoted counterclockwise by a spring about the main bearing to come up against a stop fixed to the body. One of the levers, which is articulated by one end on the main bearing, can be pivoted counterclockwise by a length-adjustable spindle which is supported in relation to the body. In this way, the lower holding link, and with it the footplate, is, on a circular path, adjusted backward predominantly in the X direction and at the same time downward slightly in the Z direction. Independent height adjustment of the footplate in the Z direction is not possible with this pedal mechanism.

SUMMARY OF THE INVENTION

A technical problem underlying the present invention consists in proposing a pedal mechanism, in which the footplate is adjustable in a range, which covers any point in a horizontal and vertical extent, and, in the case of a footplate setting which can be adapted to the force introduction angle, makes possible as horizontal as possible a movement path of the footplate on operation.

The present invention provides a pedal mechanism including a four-bar parallelogram. The pedal mechanism includes an upper holding part mounted to a sliding block having a main bearing about which the pedal mechanism is capable of being pivoted. The upper holding part is capable of being adjusted in a Z-direction. The pedal mechanism also includes a lower holding link having a footplate attached thereto and first and second legs disposed roughly parallel to each other. The first and second legs are each rotatably mounted at a first end to the upper holding part and at an opposite end to the lower holding link. The pedal mechanism also includes an adjusting device configured to adjust of the footplate predominantly in an X-direction, and a length-adjustable strut disposed between the first and second legs, a first end of the strut rotatably mounted to the first leg and en opposite end of the strut rotatably mounted to the second leg.

An illustrative embodiment, in which the adjusting device for the footplate is formed by a threaded rod which passes through nuts mounted by cardan means on both legs and has an oppositely directed thread in each case in the engagement region with the two nuts, has the advantage that it makes it possible in a simple manner to modify the four-bar parallelogram by strutting. In this way, adjustability of the footplate in or counter to the direction of travel (positive or negative X direction) is possible.

An illustrative embodiment with a threaded rod integrated in the guide rocker, which rod is in engagement with the upper holding part and the sliding block by means of oppositely directed threads, has the advantage that with it adjustment of the parts, holding part or sliding block, displaced in the vertical direction (Z direction) is made possible in a simple manner.

An illustrative embodiment, in which the ratio which the pitches of the right-hand thread and of the left-hand thread bear to one another is the transmission ratio, has the advantage that, by virtue of the different pitches, the modification of the distance between the pressure point and the main bearing can be converted into a corresponding modification of the distance between the main bearing and the pushrod bearing, so that the transmission ratio is retained on adjustment of the footplate also. In this way, it is advantageously guaranteed that, with the same force action on the footplate, the same output force is active on the pushrod bearing. The retention of the height position of the pushrod bearing makes it possible, moreover, for the angular position of the pushrod bearing to be retained advantageously virtually unchanged.

An illustrative embodiment, in which the upper holding part and the sliding block are interconnected via a cable pull and a deflection mechanism, constitutes an alternative for the compensation of the lever arm lengths corresponding to the transmission ratio. The design of the deflection mechanism in the manner of a pulley block constitutes a simple adaptation possibility for taking account of the transmission ratio.

If the rear leg in the X direction is slightly longer than the front leg, the holding link, and with it the footplate attached to it, is pivoted slightly counterclockwise on adjustment of the pedal in the −X direction, so that a movement coordinate pointing in the +Z direction is compensated and the footplate is adjusted on a virtually horizontal path.

An illustrative embodiment, in which the lengths of the two connecting rods are of corresponding size, the height position of the largely horizontal path, in which the line of action of the pressure point C runs on operation, can be lowered as required.

An embodiment, in which at least one of the threaded rods for the adjustment in the X direction and the Z direction is motor-driven, has the advantage that the adjustment can be introduced in a simple manner from the control panel by corresponding control signals.

The adjustability, according to the invention, of the pedal mechanism advantageously allows the attachment of the pedal mechanisms to be removed from the splashboard which is at risk of deformation in the event of a crash, and the attachment to be carried out to crash-independent cross struts instead.

An illustrative embodiment, in which an adjustable footrest is provided for the pedal mechanism, the adjustability of which is appropriately adapted to the position of the footplate, has the advantage that the driver will find an ergonomically favorable support possibility for the foot according to the adjustment of the footplate, so that unfavourable fatigue or cramp is avoided when the footplate is adjusted.

BRIEF DESCRIPTION OF THE DRAWINGS

The advantages mentioned and other advantages are explained in the description of an illustrative embodiment shown in the accompanying drawing, in which.

DETAILED DESCRIPTION

Figure 1:
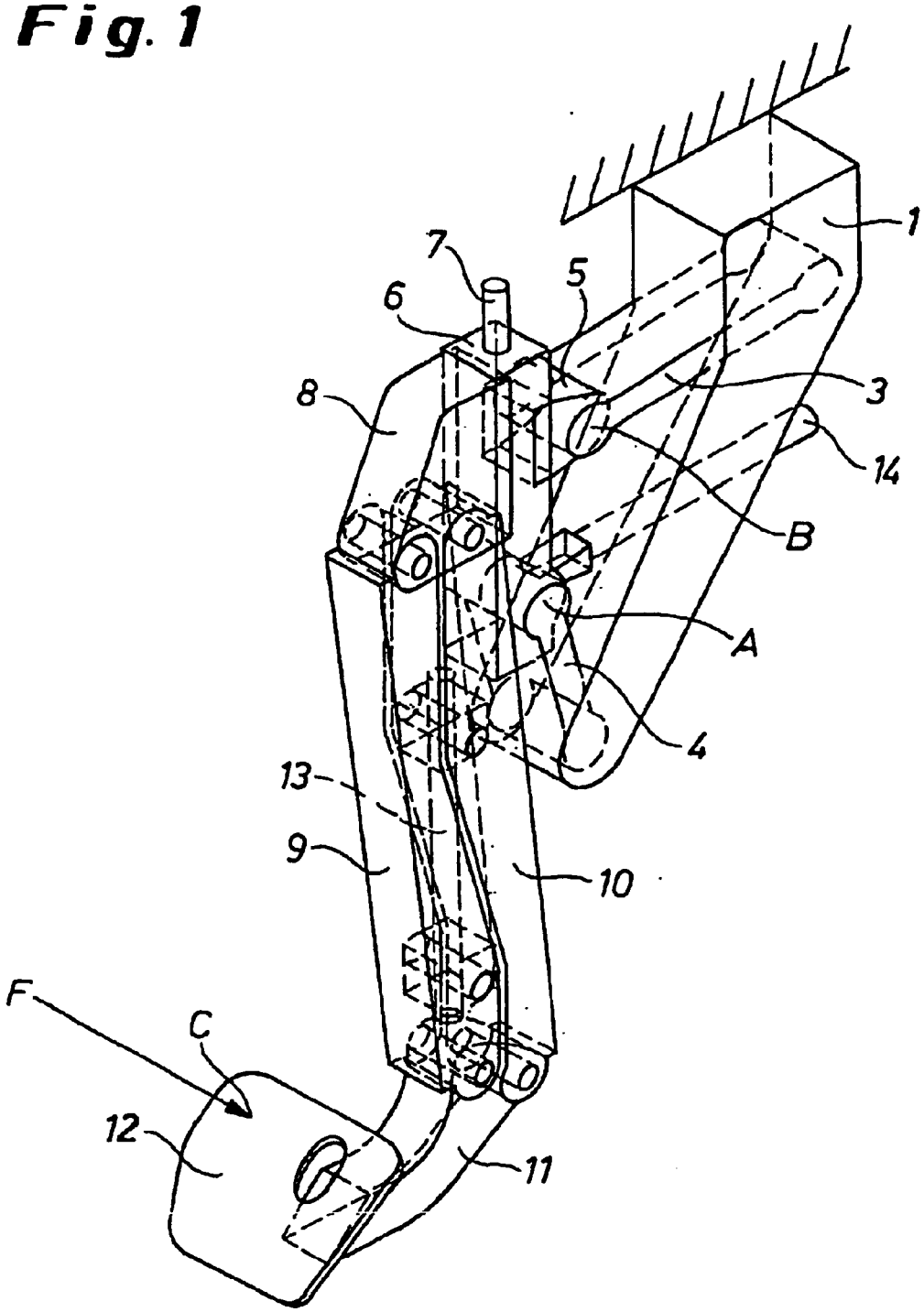
FIG. 1 shows a perspective illustration of the pedal mechanism in basic position.

In FIG. 1, the individual parts of the pedal mechanism shown as an illustrative embodiment can also be seen clearly in their functional interaction. The stationary bearing block 1 with the fixed bearings of the main bearing connecting rod 3 and of the pushrod bearing connecting rod 4, the main bearing connecting rod 3 mounted rotatably at one end in said stationary bearing block 1, and the pushrod bearing connecting rod 4 can be seen clearly, the other end of the main bearing connecting rod 3 being mounted rotatably in a main bearing B designed in a sliding block 5, and the other, free end of the pushrod bearing connecting rod 4 being mounted rotatably in a pushrod bearing A designed on the guide rocker 6. The sliding block 5 and the holding part 8 are mounted displaceably in the Z direction on the guide rocker 6. Arranged in the guide rocker 6 is a first threaded rod 7 which is in engagement with a toothing 27 of the holding part 8 and with a toothing 28 of the sliding block 5. The holding part 8 is designed as a carnage.

Articulated approximately parallel to one another from the holding part 8 mounted displaceably on the guide rocker 6 are two legs 9, 10 which are articulated by their other end on the holding link 11. The holding part 8, the two legs 9, 10 and the holding link 11 form a four-bar parallelogram. The footplate 12 is attached to the holding link 11. A first nut 21 and a second nut 22 are each mounted by cardan means in the two legs 9, 10, the nuts 21, 22 being passed through by a second threaded rod 13, wherein the second threaded rod 13 comprises a first thread 23 being in engagement with the first nut 21 and a second thread 24 being in engagement with the second nut 22. A pushrod 14, for example for a brake booster, is mounted rotatably in the pushrod bearing A, which forms the output point of the pedal mechanism.

Figure 2:
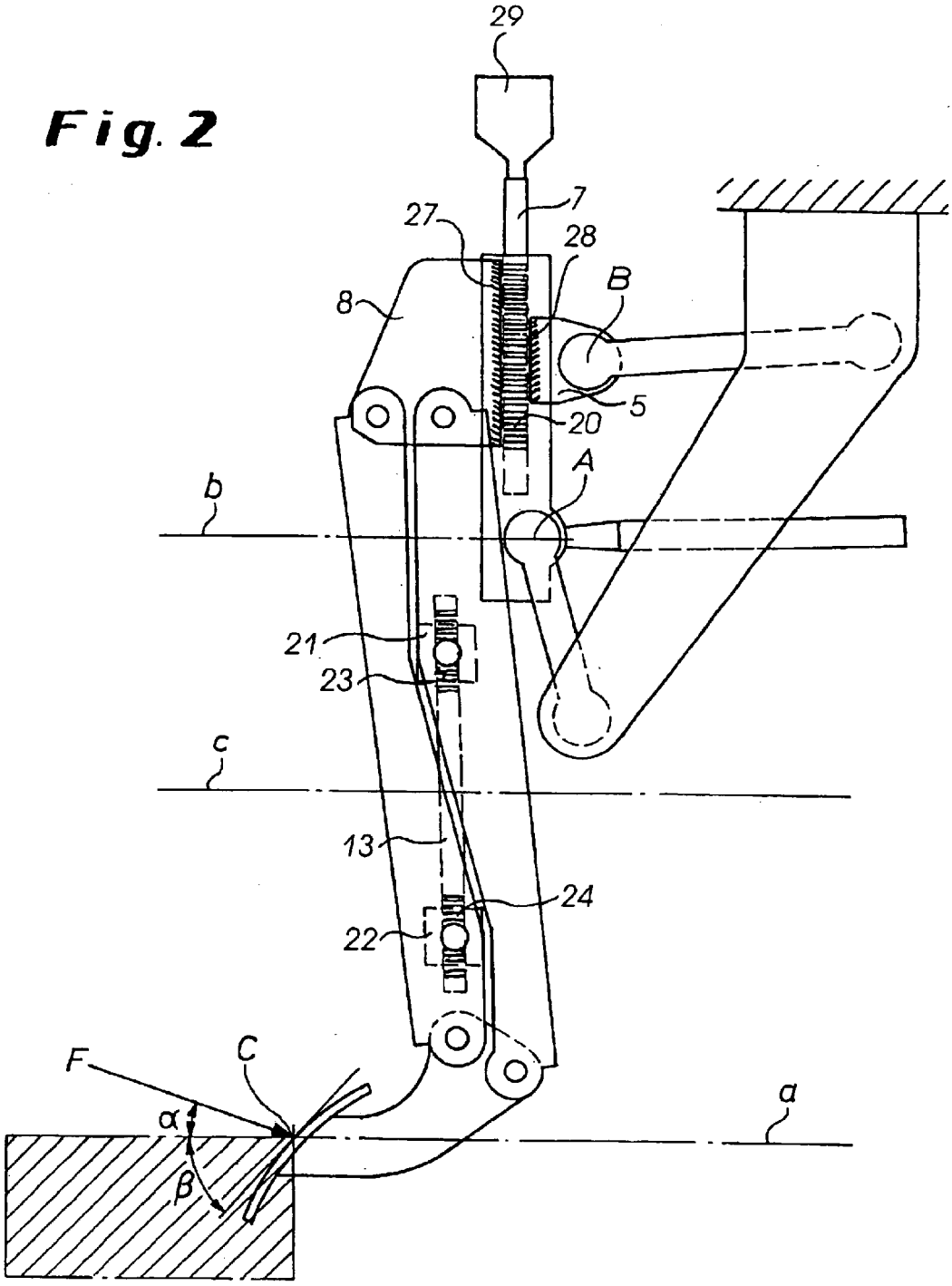
FIG. 2 shows a diagrammatic side view of the pedal mechanism.

In FIG. 2, in which a side view of the pedal mechanism in a basic position is illustrated diagrammatically, the main bearing B, the force introduction point or pressure point C and the output point A, which is located in the pushrod bearing A are marked individually. The operating force F forms the force introduction angle a to the horizontal. The footplate has a setting angle β in relation to the horizontal. Starting from the pressure point C, a rectangular area is illustrated by hatching, which outlines the coordinates of the envisaged adjustability of the pedal mechanism in the −Z and the −X direction. Also drawn in are horizontal paths a, b and c, which indicate movement paths of the pressure point C (a), of the pushrod bearing A (b) and of the footplate 12 with a different connecting rod geometry (c).

Figure 3:
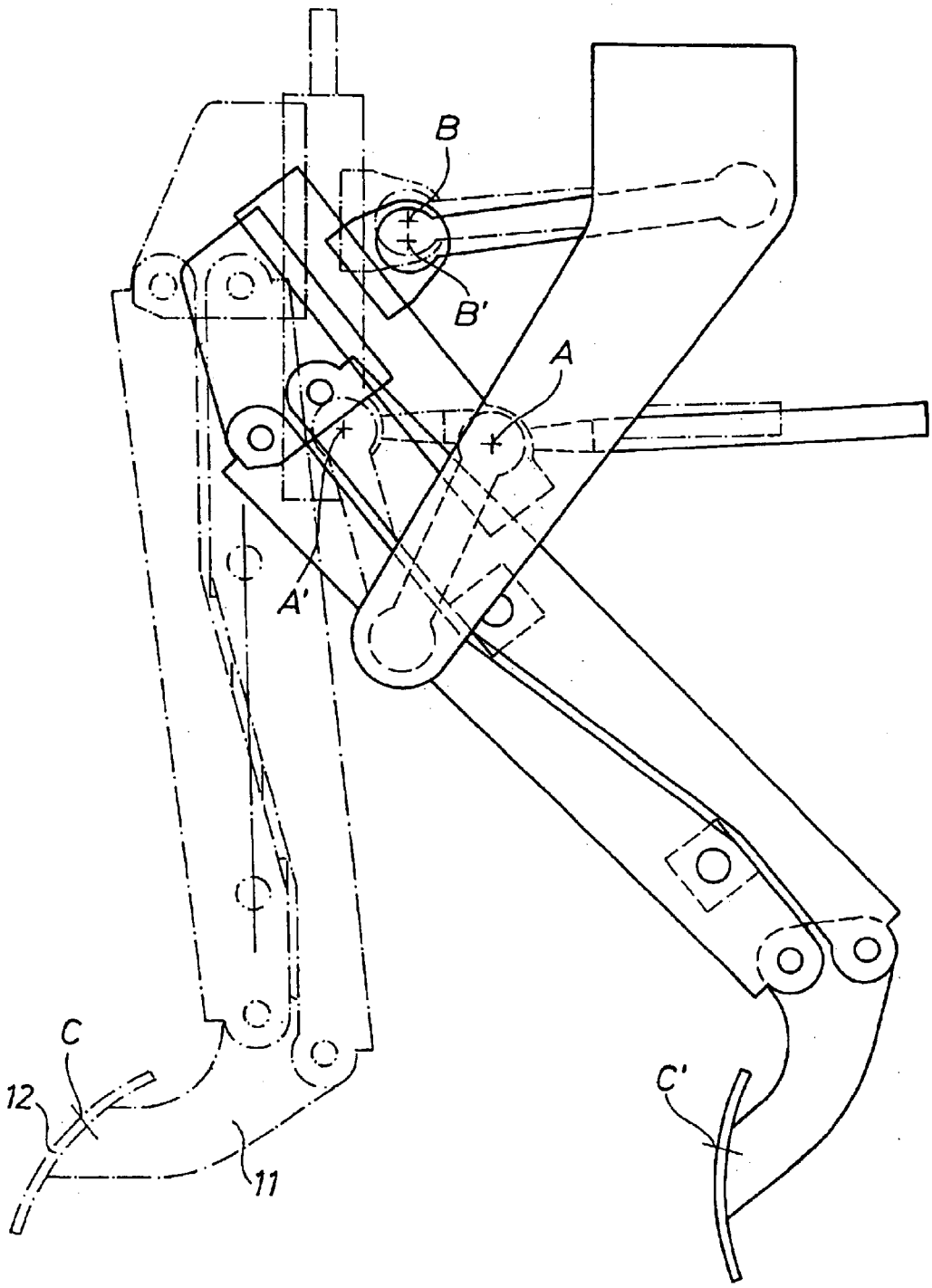
FIG. 3 shows a side view of the pedal mechanism in basic position and after operation.

In FIG. 3, the broken lines illustrate the pedal mechanism in basic position, and the solid lines illustrate the pedal mechanism after operation in the X direction. It is clearly visible that, on operation, the footplate 12 has moved approximately on a horizontal path, and that the lower holding link 11 with the footplate 12 attached thereto, has been pivoted counterclockwise slightly. It can furthermore be seen that the main bearing B has been displaced slightly in the −Z direction or a pivoting path about the articulation of the main bearing connecting rod 3 on the bearing block in −Z. The pushrod bearing A has been pivoted on a virtually horizontal path in the X direction on a pivoting path about the articulation of the pushrod bearing connecting rod 4 on the bearing block!in the X direction.

Figure 4:
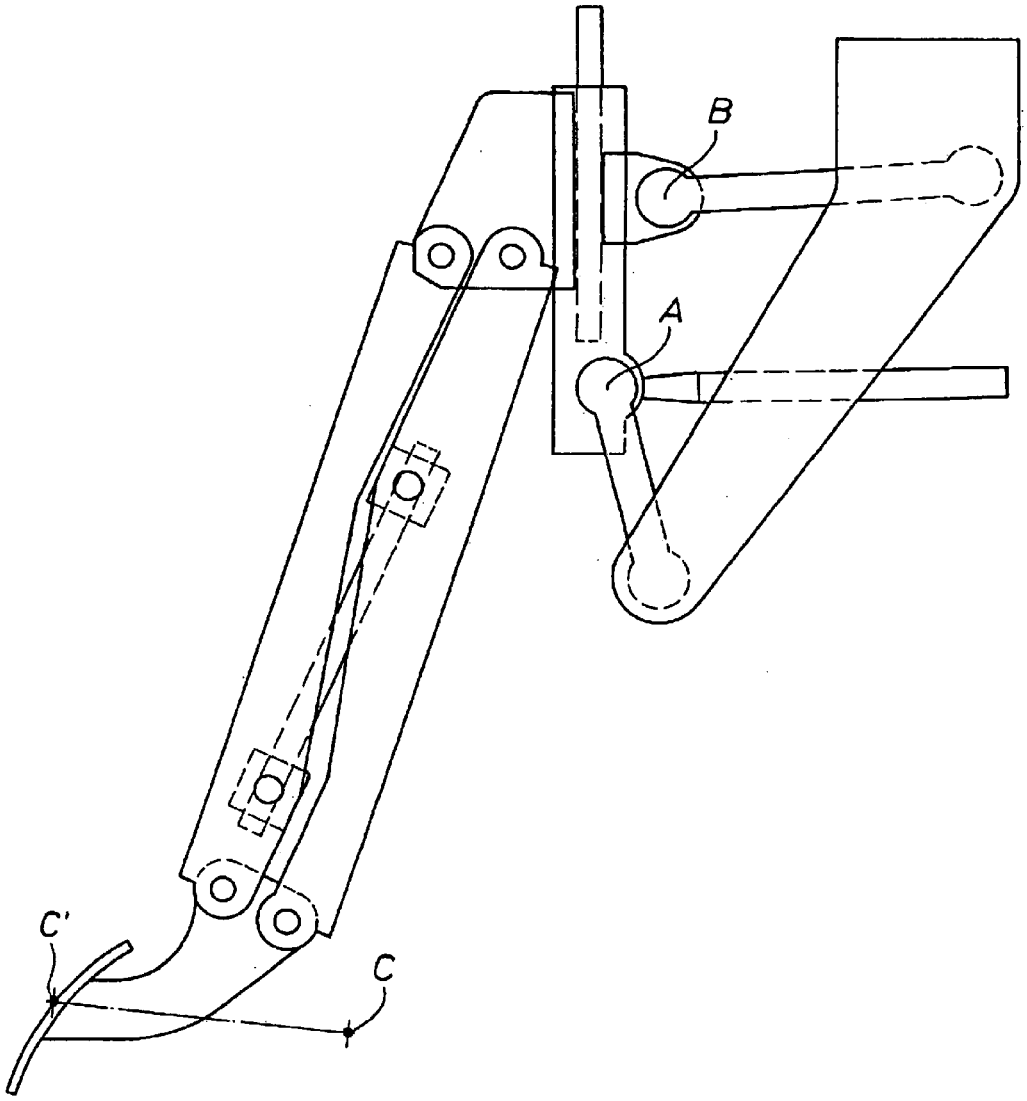
FIG. 4 shows the pedal mechanism after adjustment in the negative X direction (−X)
Figure 5:
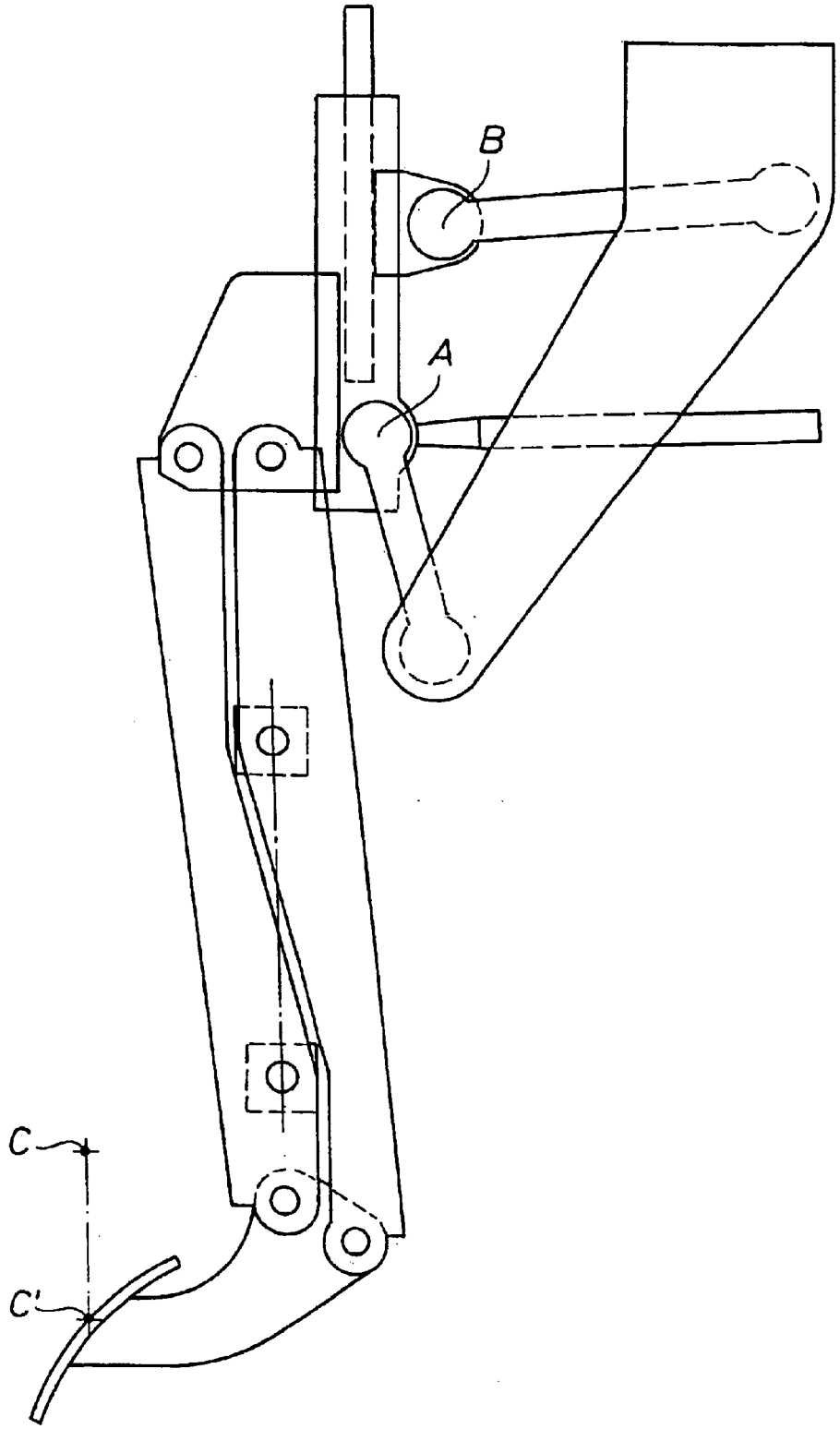
FIG. 5 shows a side view of the pedal mechanism in a position adjusted in the negative Z direction (−Z) in relation to the basic position.

FIG. 4 illustrates the pedal mechanism in a position adjusted in −X from C to C', and FIG. 5 shows it in a position adjusted form C to C' after adjustment in the −Z direction.

Figure 6:
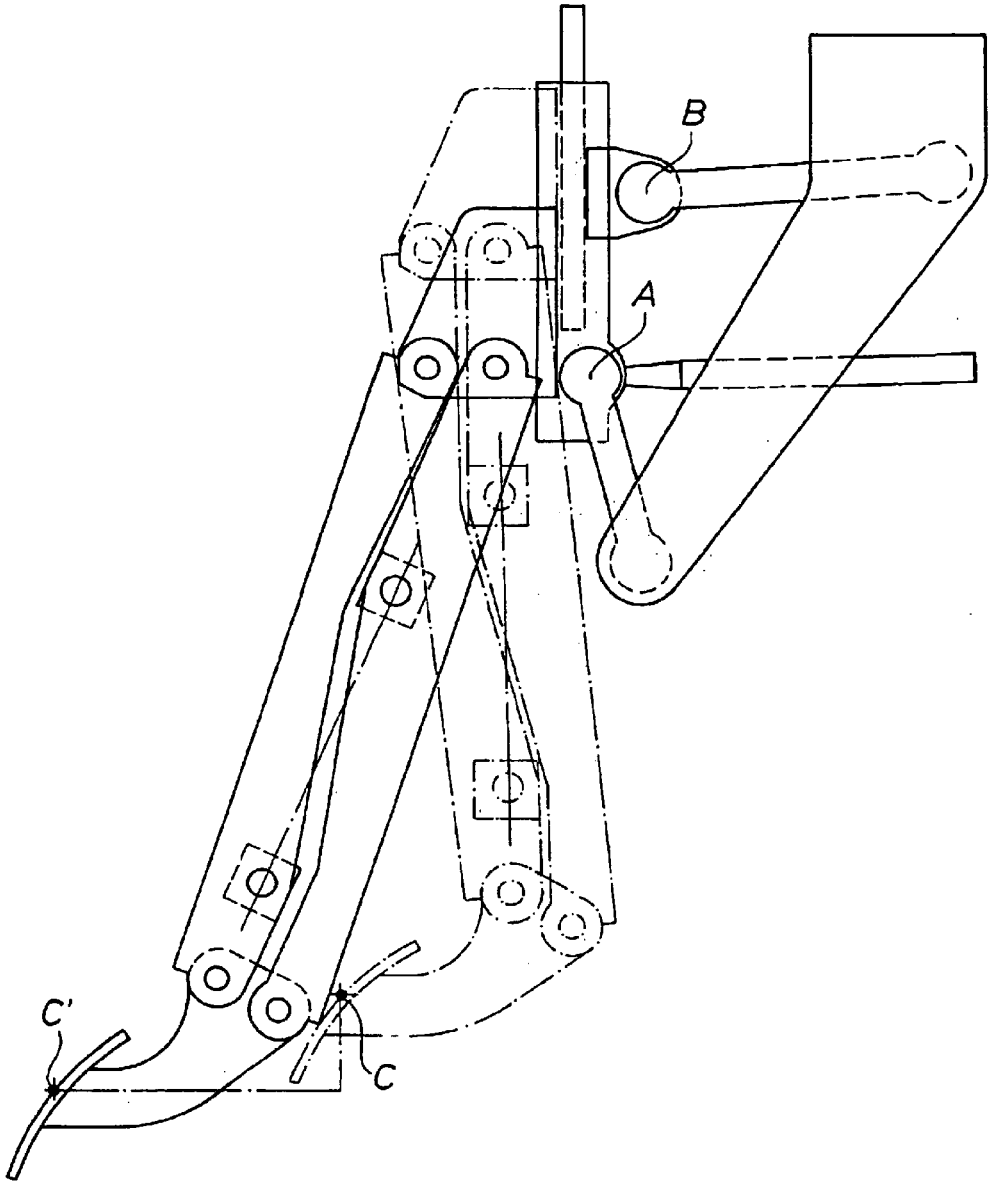
FIG. 6 shows a side view of the pedal mechanism in a position adjusted in −X and −Z in relation to the basic position.

FIG. 6 illustrates the position of the pedal mechanism after adjustment in −X and −Z from C to C'. In all three illustrations in FIG. 4 to FIG. 6, the position after adjustment is shown without compensation of the lever transmission ratio. The lever transmission ratio ü is defined by the ratio of the lengths CB/BA. Compensation of the lever transmission ratio ü is this lever transmission ratio being retained after adjustment also.

Figure 8:
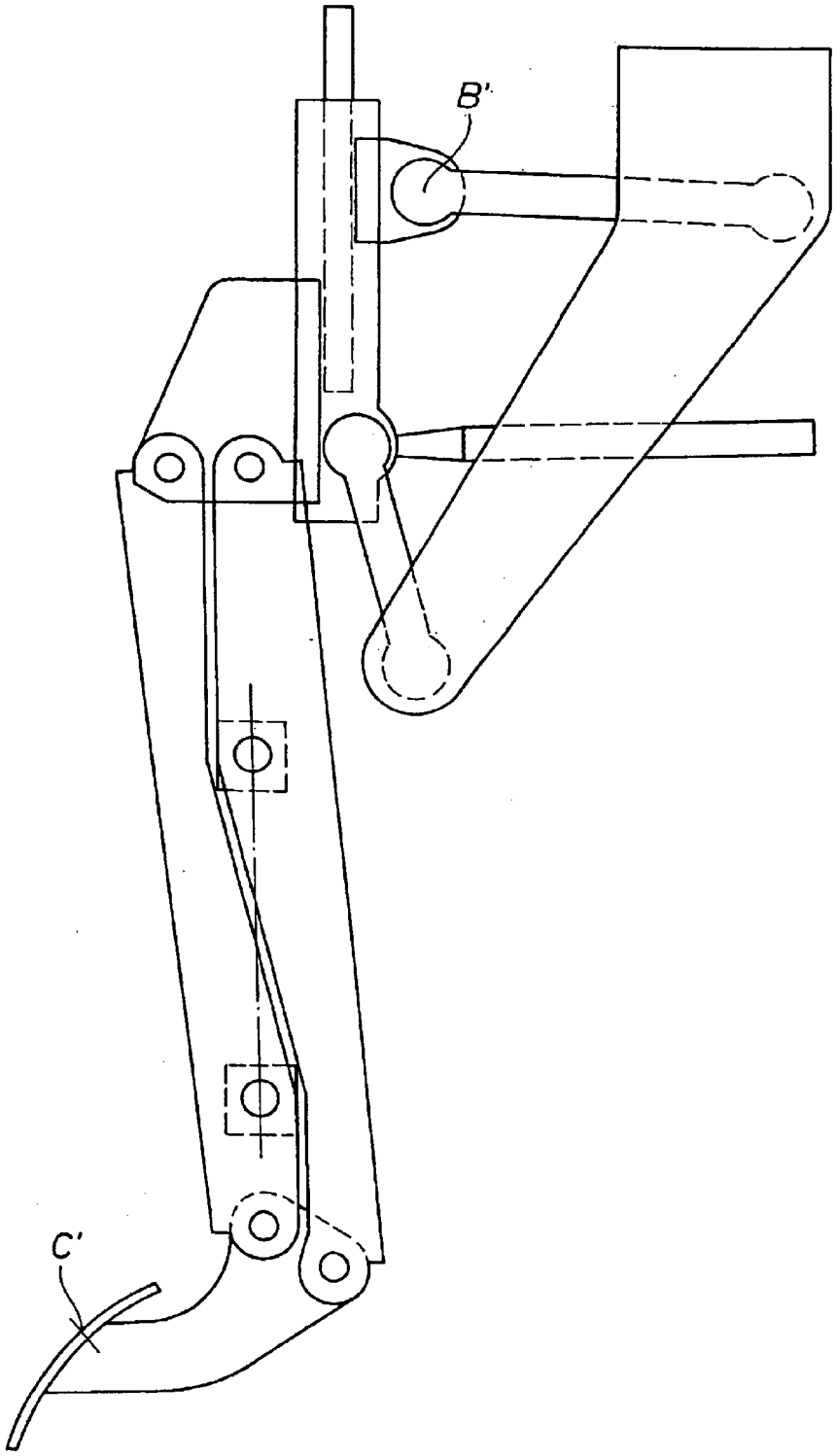
FIG. 8 shows the pedal mechanism adjusted in −Z with compensation of the lever transmission ratio.
Figure 9:
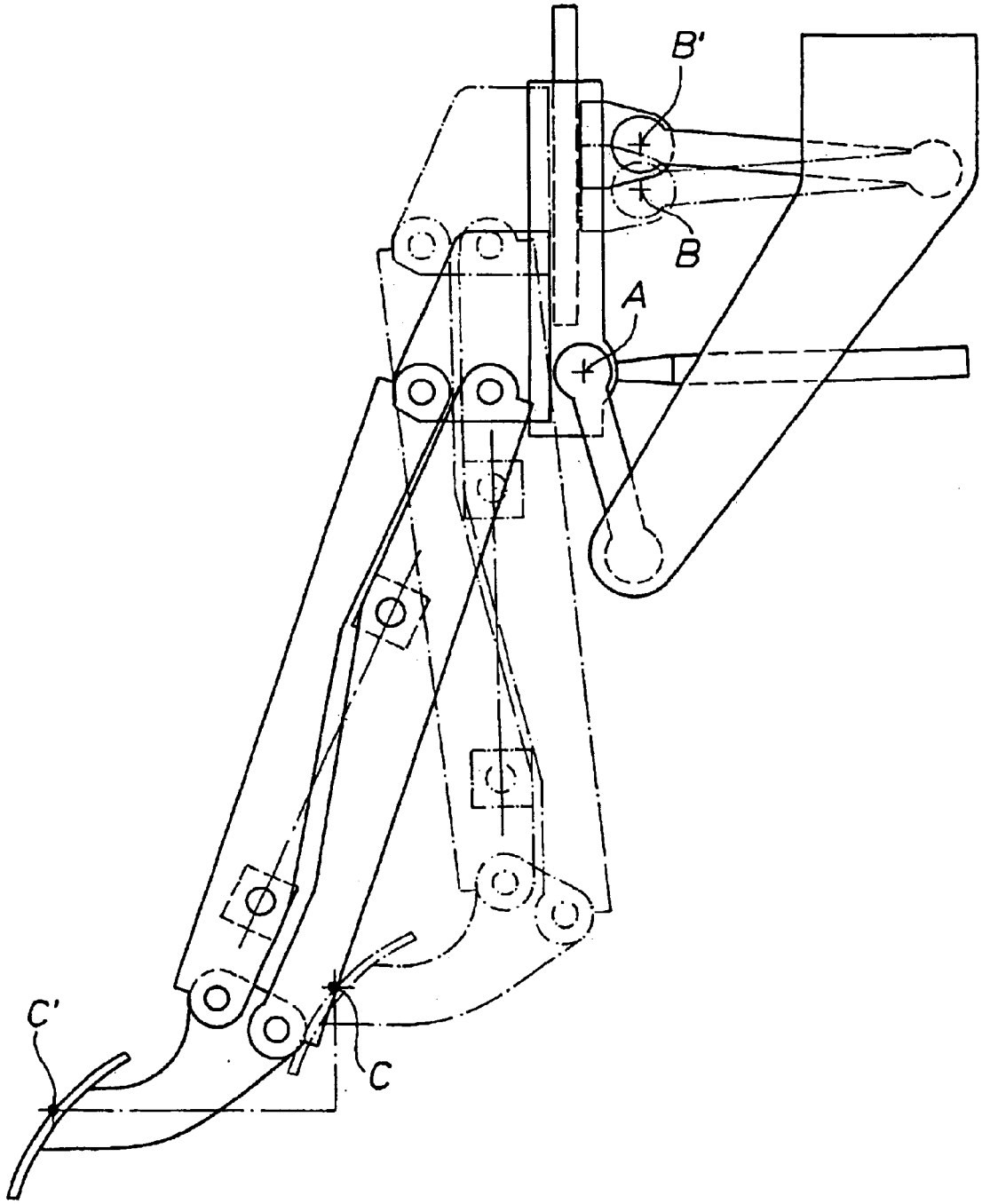
FIG. 9 shows the pedal mechanism adjusted in −X and −Z with compensation of the transmission ratio.

The operational interrelation for compensation of the lever transmission ratio is explained with reference to the illustration in FIG. 7 to FIG. 9.

Figure 7:
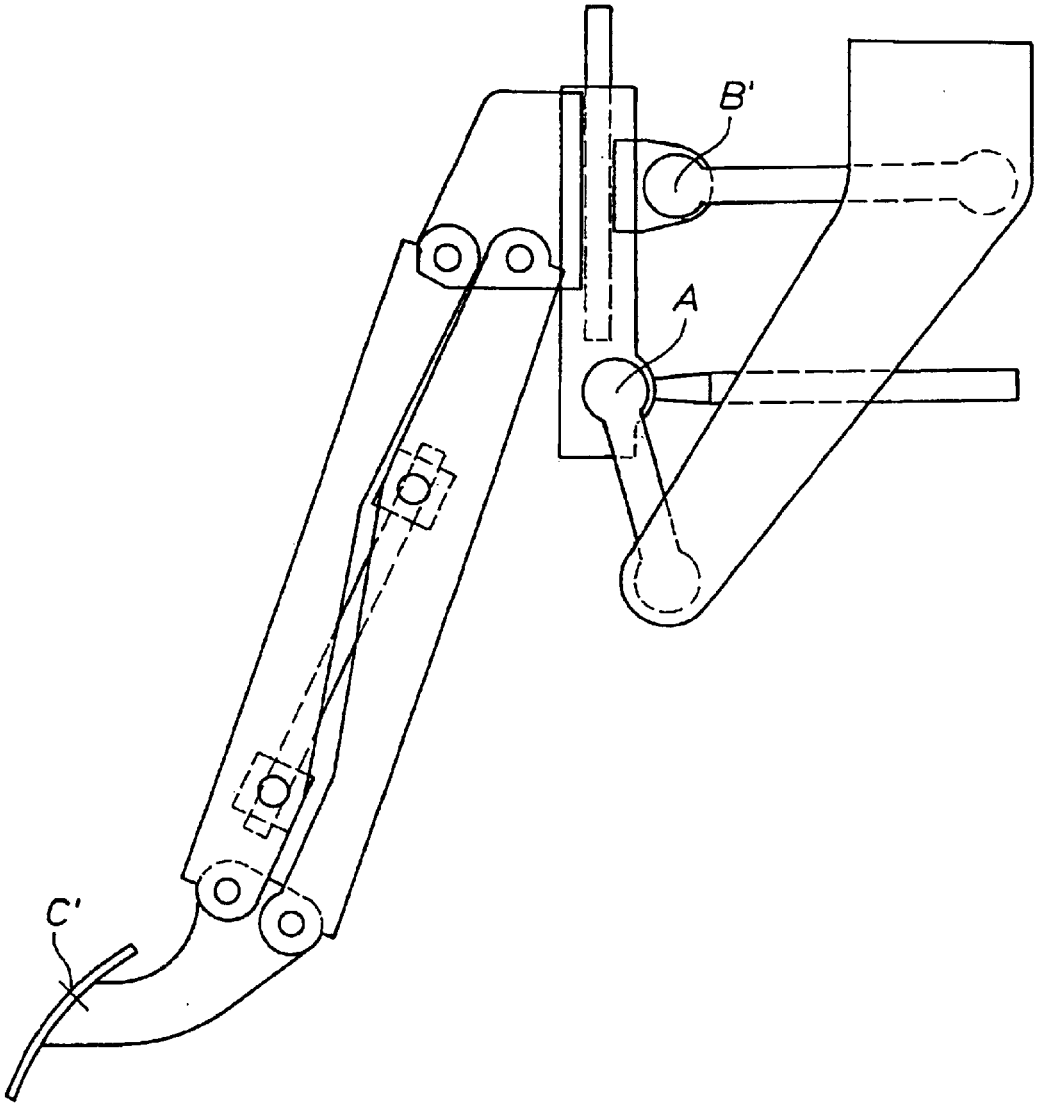
FIG. 7 shows the pedal mechanism adjusted in −X with compensation of the transmission ratio.

It can be seen in FIG. 7 that, on adjustment of the footplate 12 toward −X, the main bearing B is displaced upward slightly. After an adjustment in −Z, as illustrated in FIG. 8, the main bearing B is displaced upward still more clearly. This displacement of the main bearing B to B' to compensate the lever transmission ratio ti on adjustment of the footplate 12 in −X and −Z is very clear from the double illustration in FIG. 9. As the lever CB is lengthened when C is adjusted to C', the lever length AB must also be lengthened, in order for the lever length ratio C'B'/B'A to be the same as CB/BA. As the height of the output point A in the pushrod bearing is not to be changed, the main bearing B must be displaced to B' to compensate the lever transmission ratio. This results in the requirement that the difference of the lever arm length from C' to B' in comparison with CB changes in relation to the difference of AR' in comparison with AR proportionally to the lever transmission ratio CB/BA.

The adjusting arrangement is designed in such a manner that no adjustment is possible during operation of the pedal mechanism. After adjustment, the structure from footplate to sliding block, and thus from C to B, is to be regarded as rigid.

Figure 10:
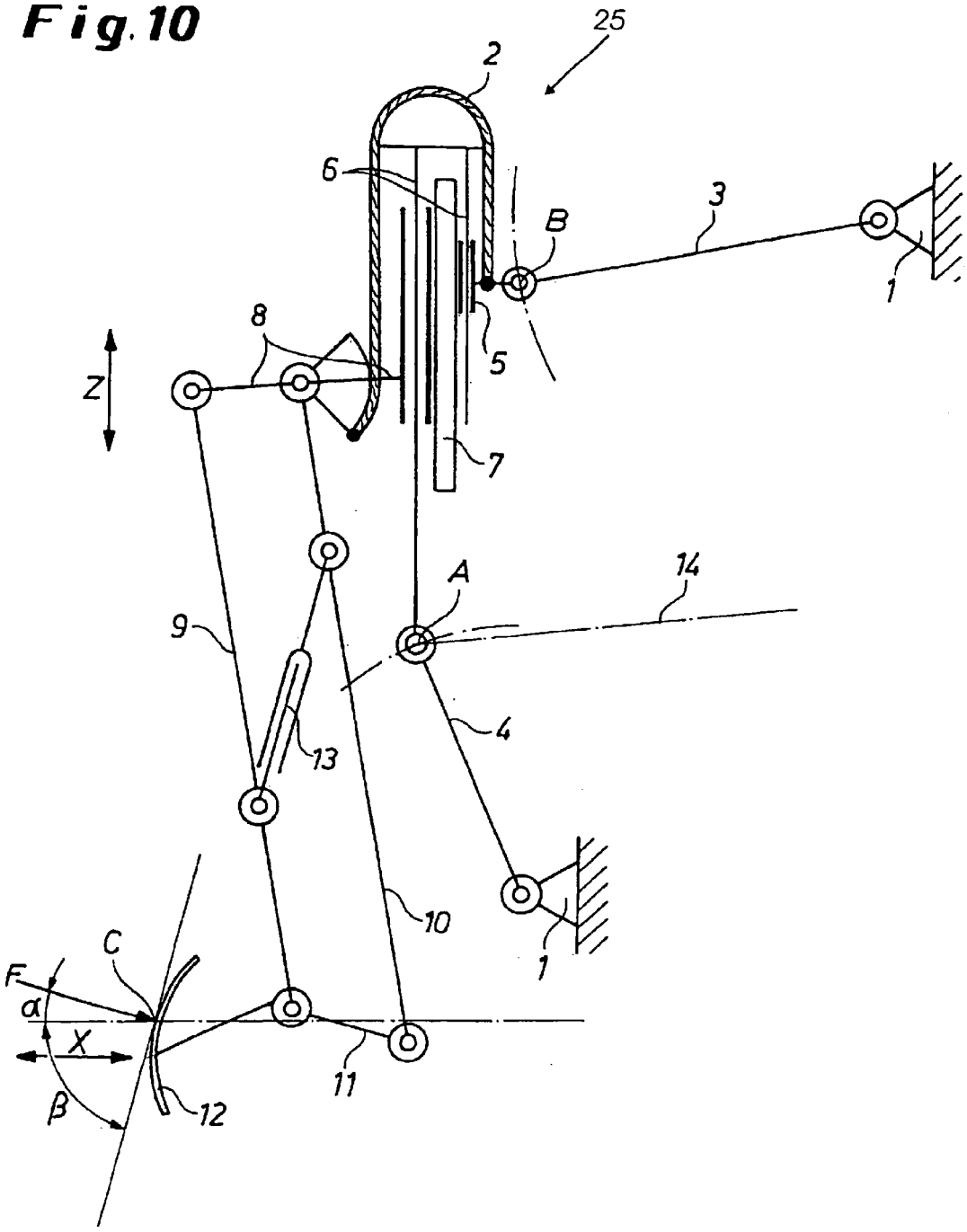
FIG. 10 shows a schematic diagram of a pedal mounting.

FIG. 10 shows a schematic diagram of the pedal mechanism in an illustration which is to a great extent comparable with FIG. 1. One difference between the illustrations in FIG. 1 and FIG. 10 concerns the compensation of the transmission ratio on adjustment in the Z direction, which is carried out in FIG. 1 by means of a first threaded rod 7 with different pitches of the oppositely directed threaded portions and in FIG. 10 by means of a deflection mechanism 25 comprising a cable pull 2 and a pulley block.

What is claimed is:

1. A pedal mechanism comprising:

an upper holding part;

a sliding block having a main bearing about which the pedal mechanism is capable of being pivoted, the upper holding part mounted with respect to the sliding block so as to be adjustable in a Z-direction with respect to the sliding block;

a lower holding link having a footplate attached thereto;

first and second legs disposed substantially parallel to each other, the first and second legs each rotatably mounted at a first end to the upper holding part and at an opposite end to the lower holding link; and an adjusting device disposed between the first and second legs and configured to adjust of the footplate predominantly in an X-direction, wherein the adjusting device includes a length-adjustable strut, a first end of the strut being rotatably mounted to the first leg and an opposite end of the stint being rotatably mounted to the second leg.

2. The pedal mechanism as recited in claim 1, further comprising:

a stationary bearing block;

a guide rocker including a pushrod bearing, wherein the upper holding part and the sliding block are connected to the guide rocker;

a main bearing connecting rod having a first end rotatably mounted to the stationary bearing block and an opposite end rotatably mounted to the main bearing; and a pushrod bearing connecting rod having a first end rotatably mounted to the stationary bearing block and an opposite end rotatably mounted to the pushrod bearing.

3. The pedal mechanism as recited in claim 2, wherein a length of the main bearing connecting rod and a length of the pushrod bearing connecting rod are determined in coordination with the bearing block in such a manner that, during operation of the pedal mechanism, a line of action of a pressure point of the foot plate runs on a substantially horizontal path and at a predetermined height position.

4. The pedal mechanism as in claim 2, wherein the guide rocker includes a first threaded rod integrated therein, the first threaded rod having a first thread in engagement with toothings of the upper holding part and a second thread in engagement with toothings of the sliding block, the second thread running in an opposite direction to the first thread.

5. The pedal mechanism as recited in claim 4, wherein the adjusting device includes a first nut cardan-mounted on the first leg, a second nut cardan-mounted on the second leg, and a second threaded rod passing through the first and second nuts, the second threaded rod having a first thread in an engagement region with the first nut and a second thread in engagement region with the second nut, the second thread running in an opposite direction to the first thread.

6. The pedal mechanism as recited in claim 5, wherein at least one of the first and second threaded rods is motor-driven.

7. The pedal mechanism as recited in claim 5, wherein the first threads of the first and second threaded rod have a first pitch and the second threads of the first and the second threaded rods have a second pitch different from the first pitch, and wherein a pitch ratio between the first and second pitches corresponds to a transmission ratio between a first lever arm, defined as a distance between a pressure point on the footplate and the main bearing, and second lever arm defined as a distance between the pushrod and the main bearing.

8. The pedal mechanism as recited in claim 1, further comprising a deflection mechanism including a cable pull, the cable pull including a first end connected to the upper holding part and a second end connected to the sliding block.

9. The pedal mechanism as recited in claim 1, wherein the upper holding part, the lower holding link, and the first and second legs are configured in such a maimer that an adjustment of the foot plate in the X-direction follows a horizontal path.

10. The pedal mechanism as recited in claim 1, wherein the second leg is disposed rearward of the first leg in the X-direction and is slightly longer than the first leg, and wherein both of the first and second legs are articulated on a same level on the upper holding part.

11. A pedal mechanism comprising:

a stationary bearing block; and a pedal pivotably connected to the stationary bearing block, the pedal including:

an upper holding part;

a lower holding link;

a first leg having a first end and a second end being opposite of the first end, wherein the first end is rotatably mounted to the upper holding part and the second end is rotatably mounted to the lower holding link;

a second leg being arranged substantially parallel to the first leg and having a first end and a second end being opposite of the first end, wherein the first end is rotatably mounted to the upper holding part and the second end is rotatably mounted to the lower holding link; a footplate mounted at the lower holding link;

a sliding block being for connecting the upper holding part and to the stationary bearing block, wherein the upper holding part is capable of being adjustable in a Z-direction with respect to the sliding block; and an adjusting device for adjusting the footplate predominantly in an X-direction including a length-adjustable strut, a first end of the strut being rotatably mounted to the fist leg and an opposite end of the strut being rotatably mounted to the second leg.

12. A pedal mechanism comprising:

a stationary bearing block; and a pedal pivotably connected to the stationary bearing block, the pedal including:

an upper holding part;

a lower holding link;

a first leg having a first end and a second end being opposite of the first end, wherein the first end is rotatably mounted to the upper holding part and the second end is rotatably mounted to the lower holding link;

a second leg being arranged substantially parallel to the first leg and having a first end and a second end being opposite of the first end, wherein the first end is rotatably mounted to the upper holding part and the second end is rotatably mounted to the lower holding link;

a footplate mounted at the lower holding link;

a sliding block being for connecting the upper holding part and to the stationary bearing block, wherein the upper holding part is capable of being adjustable in a Z-direction with respect to the sliding block; and an adjusting device for adjusting the footplate predominantly in an X-direction including a first nut cardan-mounted on the first leg, a second nut cardan-mounted on the second leg, and a threaded rod passing through the first and second nuts, the threaded rod having a first thread in an engagement region with the first nut and a second thread in engagement region with the second nut, the second thread running in an opposite direction to the first thread.

* * * * *